US008015663B2

(12) United States Patent
Vorpahl

(10) Patent No.: US 8,015,663 B2
(45) Date of Patent: Sep. 13, 2011

(54) FUNGIBLE FURNITURE GLIDE

(76) Inventor: Steven A. Vorpahl, Concord, CA (US)

( * ) Notice: Subject to any disclaimer, the term of this patent is extended or adjusted under 35 U.S.C. 154(b) by 400 days.

(21) Appl. No.: 12/231,008

(22) Filed: Aug. 28, 2008

(65) Prior Publication Data

US 2009/0056071 A1 Mar. 5, 2009

Related U.S. Application Data

(63) Continuation-in-part of application No. 11/393,205, filed on Mar. 30, 2006, now abandoned.

(51) Int. Cl.
*A47B 91/04* (2006.01)

(52) U.S. Cl. ..... 16/42 R; 16/20; 248/346.11; 297/463.1

(58) Field of Classification Search ..... 16/42 R, 16/42 T, 18 R, 20; 248/188.9, 346.11; 297/463.1; 312/351.11

See application file for complete search history.

(56) References Cited

U.S. PATENT DOCUMENTS

| | | | | |
|---|---|---|---|---|
| 786,210 | A | 8/1904 | Gould | |
| 822,963 | A | 6/1906 | Little | |
| 1,208,546 | A | 12/1916 | Hachmann | |
| 1,341,133 | A | 5/1920 | Johnson | |
| 1,659,540 | A | 2/1928 | Larsen | |
| 1,734,058 | A | 11/1929 | Sutton | |
| 1,869,574 | A | 8/1932 | Miller | |
| 2,699,567 | A * | 1/1955 | Kramcsak, Jr. | 16/42 R |
| 2,860,368 | A | 11/1958 | Thornsbury | |
| 2,954,636 | A | 10/1960 | Gammache | |
| 3,021,551 | A | 2/1962 | Kramcsak | |
| 3,080,601 | A * | 3/1963 | Kramcsak, Jr. | 16/42 R |
| 3,166,782 | A * | 1/1965 | Miller | 16/42 R |
| 3,191,213 | A * | 6/1965 | Congdon | 16/42 R |
| 3,505,724 | A * | 4/1970 | Sator et al. | 29/432.2 |
| 3,722,026 | A * | 3/1973 | Wilhelmi | 16/42 T |
| 3,858,271 | A | 1/1975 | Howard | |
| 5,010,621 | A | 4/1991 | Bock | |
| 5,573,212 | A * | 11/1996 | Palazzolo | 248/188.9 |
| 6,154,923 | A | 12/2000 | Carpinella | |
| 6,405,982 | B2 | 6/2002 | Ferencz | |
| 6,754,934 | B1 * | 6/2004 | Shiffler | 16/42 R |
| 6,869,052 | B2 | 3/2005 | Keast et al. | |

FOREIGN PATENT DOCUMENTS

WO PCT/US07/06638 8/2007

* cited by examiner

*Primary Examiner* — William L. Miller

(57) ABSTRACT

A three component swiveling and rolling glide device, of which two components comprise the mounting assembly and one is an exchangeable base. The mounting assembly is designed to accept multiple fasteners such as screws, bolts, pins or nails. The glide base is removable by finger pressure only without the need for tools enabling the easy interchangeability of the glide base and the fastener as desired. This glide also has a tandem swiveling and rolling capability and will adapt to a singular rolling function in deep carpets or whenever the glide is at maximum tilt. The hard base has a unique base design to encourage the swiveling and rolling action of the glide. The soft base can accept different materials for the specific need, such as, felt to protect hardwood or tile flooring or rubber for a non-skid function. This glide is designed to combine all the above functions, allowing it to adapt to multiple furniture and flooring styles.

4 Claims, 2 Drawing Sheets

FUNGIBLE FURNITURE GLIDE

RELATED APPLICATIONS

This application is a Continuation in Part of patent application Ser. No. 11/393,205 filed on Mar. 30, 2006, now abandoned, and Related PCT Application Number PCT/US07/06638.

BACKGROUND OF THE INVENTION

This invention is an improvement in the art of furniture glides, which are used to assist in movement of furniture or other fixtures on carpet or other flooring materials. The goal of furniture glides is to reduce friction to facilitate movement and to minimize damage to the flooring or the furniture. Many glides have provided some of these functions but choices were limited in combining the correct means of attachment with a suitable base material for the flooring on which the furniture was to be used. This invention allows for multiple combinations of movements, base styles and materials and means of attachment.

The industry of furniture glides which is the putting of levelers, carpet protection and anti-mar floor leg attachments with swivel motion was started by D. Young, H. Graf and C. Shuppert (U.S. Pat. No. 766,210—1904). Orton C. Little (U.S. Pat. No. 822,963—1906) developed an enclosed device attached to the foot of the furniture leg and had the properties of swiveling and sliding when furniture was moved. Hachmann (U.S. Pat. No. 1,208,546—1916) was the first to devise a replaceable furniture tip for his glide. In 1920, J. A. Johnson was issued U.S. Pat. No. 1,341,133 for a Sliding Shoe for Furniture. He departed from Little by adapting the furniture shoe to attach with a solid pintle stem. In 1928, Oscar Larsen was issued U.S. Pat. No. 1,659,540 for a Furniture Glider Shoe. Larsen attached his furniture shoe by screws into the furniture leg. This shoe was rigid and did not swivel, G. W. Sutton was issued U.S. Pat. No. 1,734,058 (Nov. 5, 1929) for his Sliding Furniture Shoe which provided for load distribution more evenly and for cushioning of the sliding shoe. In 1932, Robert E. Miller was issued U.S. Pat. No. 1,869,574 for a Sliding Caster. A bent wire or a 3 prong attachment afforded a simpler installation by the user.

The next major change came with the onset of tubular style furniture legs. More intricate stamped metal parts were coming into use and attachment devices had to be contrived. By 1960, numerous similar styles were being devised, such as, U.S. Pat. No. 2,854,636 issued to R. J. Gammache for his Universal Furniture Foot which offered a spring steel attachment for inside tubular legs. R. Bock (U.S. Pat. No. 5,010,621—1991) and R. Carpinella (U.S. Pat. No. 6,154,923—2000) both had similar designs with different attachment devices for tubular legs. Thornsbury (U.S. Pat. No. 2,860,368—1958) offered a three piece shoe which is permanently attached to a connector socket for insertion into a tubular leg. The center support piece being a rubber cushion giving support to the inverted pintle resting on the top surface. This glide, however, uses the pintle as the support means and the three pieces are permanently attached. The shape of the inner piece getting its form from the pressure at assembly. The stated peripheral edge portion was formed into a permanent crimp at assembly. Kramcsak (U.S. Pat. No. 3,021,551—1962) also offered a rubber for cushioning of the glide base but was also permanently assembled. It also offered a partial central hole enabling a cushion for only attachment means with the attachment means embedded in the center of the central cushion. The glide of my invention does not rely on the attachment means to assume the weight bearing responsibilities and such means can be interchanged as required. The roller glide of Howard (U.S. Pat. No. 3,858,271—1975) is a two part non-swivel glide with an optional wheel assembly inserted into the smooth base. Rotation around the center attachment stem is static and the center stem takes on the weight bearing duties. This non-swivel glide is truly a two part assembly whereas my invention is a dual swiveling and rolling three part assembly. Ferencz (U.S. Pat. No. 6,405,982—2002) shows a single piece glide using a pressure fit base to protect the floor from marring. The relatively thick base portion was designed for cushioning only, whereas, the expanded thicker bottom of my outer locking rim has a circumferential indent mating with the glide base offering a removeably mated snap, screw or press connection for assembly and removal and is not intended to provide cushioning for the glide. This, said, expanded bottom also enables the glide base of my invention to be easily removed by finger pressure only without the need for tools. Kenst and Downen (U.S. Pat. No. 6,869,052—2005) show a nailed support base into which is screwed a replaceable base and is a non-swivel glide.

I believe the combination of the choice of attachment means and base styles, along with the tandem swiveling and rolling function and the singular rolling ability of my glide make it a new and advanced design. I believe that my invention further advances the art and science of furniture glides another step and is not anticipated by any of the above prior art.

SUMMARY OF THE INVENTION

This invention advances the art of furniture feet, glides and sliding shoes. Prior inventions were intended for one basic use or function. It has been difficult to match the style of attachment required by a specific piece of furniture ie; screw, bolt, nail or solid or split pin with the material or style of glide base needed for a specific use ie: furniture resting on a carpet, rug or on a hard flooring surface ie: wood, tile, slate, marble, linoleum.

This invention allows the end user to choose the correct means of attachment for the glide and match it with the correct base material or style for the circumstance.

This invention is the first to offer the above choices including the option to easily replace and interchange bases in accordance with use or wear without replacing the mounting components, which remain intact, on the article of furniture.

This invention also reduces friction and damage to the flooring and the furniture by the ability of the base and cap to spin freely around the inner attachment swivel roller hub offering it a roller capability in addition to the standard glide function both working in tandem as the resistance requires. At the extreme swivel angle, the bottom edge of the inner swivel attachment hub rides in a matching swivel channel in the base accepting the weight bearing duties while maintaining its rolling capability.

This invention offers a hard base for soft flooring materials, such as carpet, which has a central concave indent in the outside bottom. This indent encourages the glide to tilt toward the outside edge when moved, activating the swivel roller capability in tandem with the normal glide action greatly reducing friction compared to normal glides.

This invention provides a highly adaptable, functional, stylish and reasonably priced furniture glide for all styles and quality of furniture. Unlike all prior glides, the interchangeability feature allows for the easy assembly and removal of bases with simple finger pressure without the need for tools.

DRAWING REFERENCE NUMBERS

9& 9A expanded thicker bottom of outer locking rim
10 assembled side view of three part swivel roller glide
10A cross section side view of three part swivel roller glide
10B cross section side view of the three part swivel roller glide at maximum tilt/swivel
11 top hole in outer locking rim
12 circumferential indent in outer locking rim
13 hemispherical inner angle of outer locking rim
14 top surface of inner attachment swivel roller hub
15 concave weight bearing surface of inner attachment swivel roller hub
16 countersink recess in inner attachment swivel roller hub
17 vertical flat on inner attachment swivel roller hub
18 top hole in inner attachment swivel roller hub
19 circumferential snap, screw or press ring in both bases
20 outer locking rim
21 swivel roller channel in both base styles
21*a* bottom edge of inner attachment swivel roller hub
22 convex weight bearing surface of both base styles
23 clearance space in both base styles
24 concave bottom surface of hard base
24*a* outer bottom convex edge of hard base
25 flat bottom surface of soft base
26 bottom surface material for soft base
30 inner attachment swivel roller hub
40 hard glide base
50 soft glide base
60 soft glide base material
II-II location of cross sections for FIGS. 2,3,4,5,6,7&9

DETAILED DESCRIPTION OF THE INVENTION

Figure 1:
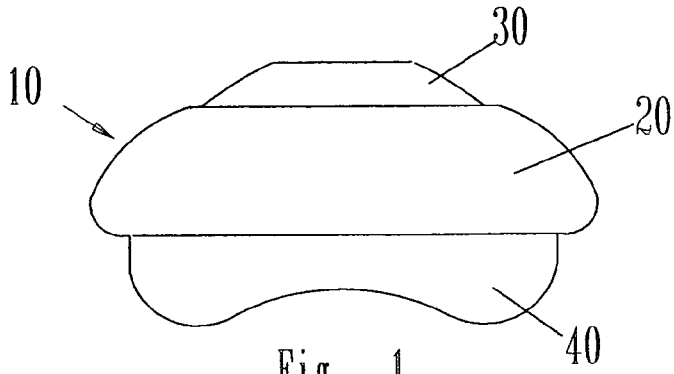
FIG. 1 Overall side view of three part swivel roller glide (Assembly 10)
Figure 2:
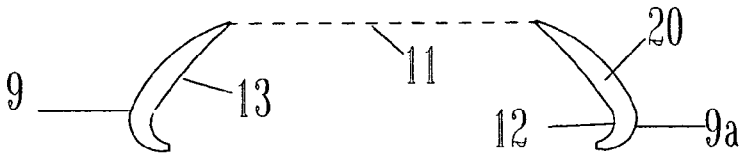
FIG. 2 Cross section of outer locking rim
Figure 3:
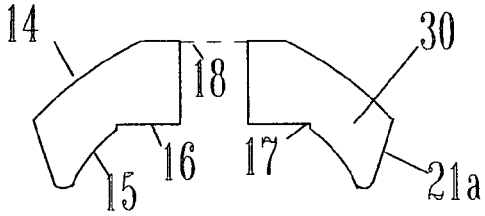
FIG. 3 Cross section of inner attachment swivel roller hub
Figure 4:
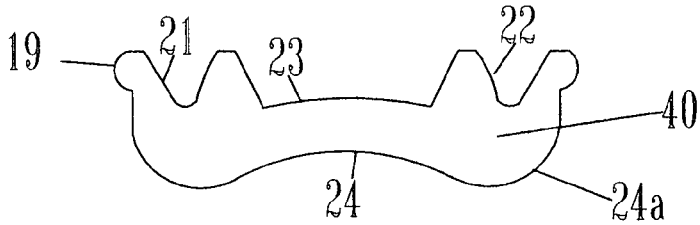
FIG. 4 Cross section of hard glide base

FIG. 1 is a side view of the swiveling and rolling glide assembly 10, according to the embodiment of the invention, consisting of, an outer locking rim 20 (FIG. 2), a central inner attachment swivel roller hub 30 (FIG. 3) and optional base 40 (FIG. 4). Optional base 50 (FIG. 5) can be interchanged with base 40. All base styles are interchangeable without the need for tools, which is part of my new concept. Making the selected base replaceable without disturbing the original mounting assembly of the central inner attachment swivel roller hub 30 and the outer locking rim 20 is a distinct advantage created by my invention. Outer locking rim 20 is fitted over the central inner attachment swivel roller hub 30 prior to mounting the central inner attachment swivel roller hub 30 to the leg or base of the article of furniture. The attachment means is then fitted upward through the center hole in both parts 20 & 30 for attachment. The mounting assembly 20 and 30 may be attached to the furniture by a variety of styles of attachments of screws, bolts, nails or split or solid pins, which is another new concept of my invention. The base, selected from bases 40 or 50, can be removeably attached to the outer locking rim 20 to complete the assembly. Either base can easily removed, with finger pressure only, by pushing the outer locking rim 20 away from base 40 or 50 toward the furniture to which it is attached until the base abutts the central inner attachment roller hub, thereby, releasing the base from the outer locking rim without disturbing the integrity of the mounting assembly. Replacement bases 40 or 50 are easily reattached by setting the base onto the central inner attachment swivel roller hub and pulling the outer locking rim up connecting the base, completing the assembly.

The outer locking rim (FIG. 2) forms a hemispherical shell which functions, as a support, to hold either base 40 or 50 (FIGS. 4&5) completing the assembly of the glide. Outer locking rim 20 has on its internal distal surface a circumferential indent 12 which mates with bases 40 or 50 (FIGS. 4&5) at the outer circumferential snap ring 19 (FIGS. 4&5) as a snap, screw or press fit removeable connection. The top hole 11 is large enough to allow for swivel movement of the central inner attachment swivel roller hub in the range from vertical to approximately 15 degrees from center in all directions. This amount of swivel is sufficient for most normal furniture styles to maintain a flat and even contact of the glide base with the floor. Outer locking rim 20 has an inner angle 13 forming an inner hemispherical shell allowing for clearance of the outside surface 14 of the central inner attachment swivel roller hub 30 (FIG. 3). This clearance allows the outer locking rim and base to rotate freely around the central inner attachment swivel roller hub enabling the tandem swiveling and rolling function of the glide. The expanded thicker bottom 9 and 9*a* of the outer locking rim 20 is intentionally larger than the diameter of the mateable base 40 or 50 (FIGS. 4&5) to allow for easy release of the base, by finger pressure alone, without the need for tools, to complete the assembly and for removal or replacement of either base style, or access to tighten or change of the means of attachment, as required.

FIG. 3 representing a cross section of the central inner attachment swivel roller hub 30, depicts a device serving as the direct connection to the article of furniture, while supporting the outer locking rim, thus completing the mounting assembly. The central inner attachment swivel roller hub 30 is fitted between the outer locking rim 20 (FIG. 2) and base 40 or 50 (FIGS. 4&5) and serves as the point of attachment to the article of furniture generally by a screw, bolt, nail or solid or split pin invertly inserted through center hole 18. Said, center hole 18 receives the means of attachment with the head of such means supported in the countersink recess 16 at the bottom of the hole and is then installed on the article of furniture. Vertical flat 17 forms said countersink recess to accept larger head styles and shapes of a variety of attachment means. Opposing angle 14, on the top of the central inner attachment swivel roller hub, is the concave weight bearing inner hub wall 15 which mates with the convex weight bearing surface 22 of either base 40 or 50 (FIGS. 4&5) enabling the tandem swiveling and rolling function of the glide. The expanded thicker bottom edge 21*a* of the central inner attachment swivel roller hub mates with swivel roller channel 21 in bases 40 or 50 (FIGS. 4&5) at maximum swivel, providing functional control of the swivel action, while transferring the weight bearing duties from the concave weight bearing surface 15 and the convex weight bearing surface 22 in bases 40 or 50 (FIGS. 4&5) to bottom edge 21*a* on the central inner attachment swivel roller hub 30 and the swivel roller channel 21 in bases 40 and 50 (FIGS. 4&5) while maintaining the singular roller capability of the glide.

Figure 5:
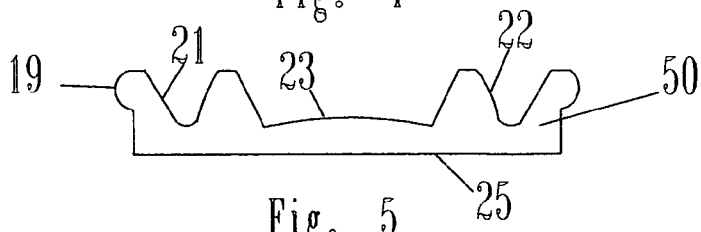
FIG. 5 Cross section of soft glide base

FIG. 4 and FIG. 5 show a cross section of the hemispherical shaped optional base styles 40 and 50. The top surfaces of these bases are identical and are mateable with the central inner attachment swivel roller hub 30 and the outer locking rim 20. In both base 40 and 50 there is a clearance space 23 to accommodate a variety of styles of attachment means, such as, screws, bolts, nails, etc. with various styles and sizes of heads. At the outer rim of each base style is a circumferential snap ring 19 which is accepted by the inner circumferential indent 12 in the outer locking rim 20 (FIG. 2) providing a removeable mating connection with outer locking rim 20 (FIG. 2) by means of a snap, screw or press fitting. The convex weight bearing surface 22 will moveably mate with the concave weight bearing surface 15 in the inner attachment swivel roller hub 30 (FIG. 3) to enable the tandem swiveling and rolling action of the free spinning outer locking rim and the connected base choice. Swivel channel 21 mates with bottom edge 21*a* of the central inner attachment swivel roller hub 30 (FIG. 3) giving it functional control of the swivel action at maximum tilt. In addition, swivel roller channel 21 and bottom edge 21*a* of the inner attachment swivel roller hub 30 accepts the full weight bearing duties of the glide for the singular rolling function at maximum tilt.

The outer bottom edge 24*a* of base 40 (FIG. 4) is a smooth convex surface to assist in the horizontal gliding movement of the glide and to act as the weight bearing roller base at maximum tilt. The smooth outside concave bottom surface 24 of base 40 (FIG. 4) enhances the tandem swiveling and rolling action of the free spinning glide base by directing the weight toward the outer bottom edge of the base to more evenly distribute weight toward the outside edge of the glide but not indent deeply into soft flooring surfaces, such as, carpets and rugs. This concave bottom surface 24 assists in initiating the movement of a piece of furniture in combination with the tandem swiveling and rolling ability of the glide. A furniture leg tends to imprint into the carpet or rug and requires the glide to swivel and roll in order to easily ride up the side of said imprint. Other glides that are flat bottomed carry the weight of the furniture evenly from the center and have more difficulty moving over deep carpet.

Figure 6:
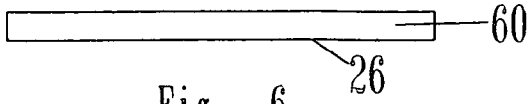
FIG. 6 Cross section of bottom surface material for soft base

The soft glide base 50 (FIG. 5) has identical features as base 40 (FIG. 4) but differs that it has a flat outer bottom surface 25 being more suitable for hard flooring such as hardwood or tile and to accommodate the attachment of a cushion 60 (FIG. 6) which generally is a base material 26, such as, felt for a sliding function and reduce floor damage or a soft rubber for a non-skid function.

Figure 7:
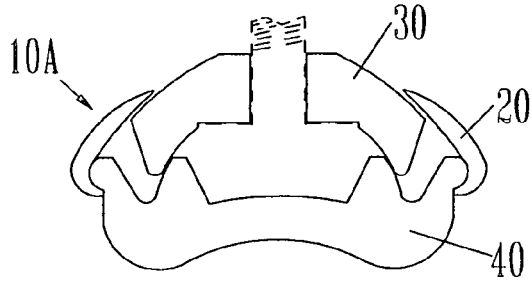
FIG. 7 Cross section of assembled three part swivel roller glide (Assembly 10A)
Figure 8:
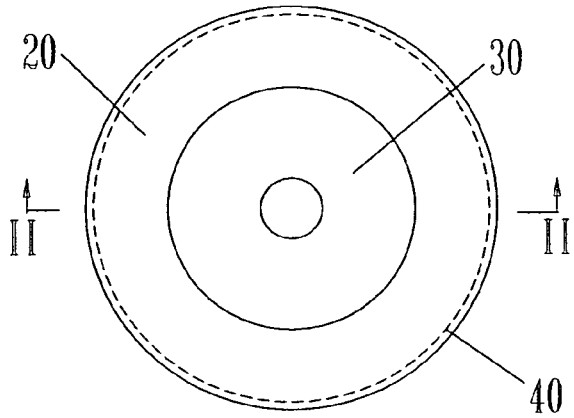
FIG. 8 Top view with vertical cross section through center line II-II.

Diagram 10A (FIG. 7) shows a cross section of the three part swivel roller glide illustrating the mating of the weight bearing members, which are, the concave weight bearing surface 15 of the inner attachment swivel roller hub 30 (FIG. 3) and the convex weight bearing surface 22 of base 40 (FIG. 4) enabling the tandem swiveling and rolling capability of the glide. Also shown are the positioning of the inner attachment swivel roller hub 30 (FIG. 3) with the attachment means, in phantom, and the outer locking rim 20 (FIG. 2) mating with the optional base 40 (FIG. 4).

Figure 9:
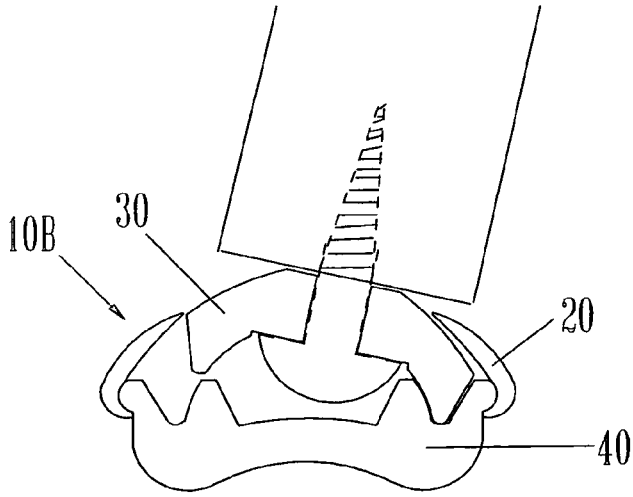
FIG. 9 Cross section of the three part swivel roller glide installed on a furniture leg at maximum tilt/swivel (Assembly 10B)

Diagram 10B (FIG. 9) depicts the mating of the bottom edge 21*a* of the inner attachment swivel roller hub 30 (FIG. 3) and swivel roller channel 21 in either base 40 or 50 (FIGS. 4&5) with the glide at maximum tilt and accepting the weight bearing duties of the glide.

I believe the combination of the choices of attachment means and base styles, along with the tandem swiveling and rolling action and the singular functional rolling ability of my glide make it a new and advanced design.

Those skilled in the art will recognize that certain variations can be made to the illustrated embodiments. It is the intention of the applicant to cover all such modifications and alternatives as may fall within the true scope of the invention as defined by means of the appended claims.

I claim:

1. A three part swiveling and rolling glide comprising:

an outer locking rim, a central inner attachment swivel roller hub, and a hard or soil glide base, said outer locking rim and central inner attachment swivel roller hub forming a mounting, assembly, said mounting assembly being directly attached to an article of furniture by an attachment means;

said outer locking rim being a hemispherical shell having a large central hole in a top thereof to accommodate swivel clearance of the central inner attachment swivel roller hub and having an expanded thicker bottom with an inner circumferential indent, said inner circumferential indent mating with said glide base and having a hemispherical inner angle, said hemispherical inner angle providing sufficient interior clearance allowing a tandem swiveling and rolling function of the outer locking rim and base around the central inner attachment swivel roller hub;

said central inner attachment swivel roller hub being a circular dome shaped device located between the outer locking rim and the glide base, said central inner attachment swivel roller hub having a central hole which has at its bottom an inner countersink recess to accommodate a head of the attachment means, said attachment means selected from screws, bolts, split or solid pins, and said central inner attachment swivel roller hub having a vertical flat surface forming said recess to allow for additional clearance for the head of the attachment means, said central inner attachment swivel roller hub having a concave shaped inner support surface mating with a raised convex central portion of the glide base enabling the tandem swiveling and rolling function, said central inner attachment swivel roller hub having a bottom edge mating with a swivel roller channel in the glide base acting as functional support and accepting full weight bearing duties when at maximum swivel enabling a singular rolling function;

said hard or soil glide base being hemispherical in shape, having a central recess to accommodate the head of the attachment means, and having an outer circumferential snap, screw or press fit connection mating with the inner circumferential indent in the outer locking rim enabling detachable fitting of the mounting assembly to the glide base.

2. The glide claim 1, said expanded thicker bottom of said locking rim having a larger diameter than the attached base to allow for the disengagement of the base from the mounting assembly by finger pressure only on the thicker expanded bottom without disturbing the integrity of the mounting assembly.

3. The glide of claim 1, said glide base being a hard glide base having a central outside bottom concave recess, said central outside bottom concave recess enhances the tandem swiveling and rolling function by directing a weight bearing surface to an outer edge of the glide base when in contact with deep carpet or other soft flooring material.

4. The glide of claim 1, said glide base being a soft glide base having a flat outer bottom, said flat outer bottom providing a surface to prevent damaging smooth flooring and to attach to a suitable base material.

* * * * *